US008262278B2

(12) United States Patent
Yanoff

(10) Patent No.: US 8,262,278 B2
(45) Date of Patent: Sep. 11, 2012

(54) CONCRETE MIXING SYSTEM

(75) Inventor: Troy J. Yanoff, Wantage, NJ (US)

(73) Assignee: Mortrex LLC, Wantage, NJ (US)

( * ) Notice: Subject to any disclaimer, the term of this patent is extended or adjusted under 35 U.S.C. 154(b) by 505 days.

(21) Appl. No.: 12/392,835

(22) Filed: Feb. 25, 2009

(65) Prior Publication Data

US 2010/0232252 A1 Sep. 16, 2010

Related U.S. Application Data

(63) Continuation-in-part of application No. 12/361,198, filed on Jan. 28, 2009, now abandoned.

(60) Provisional application No. 61/026,517, filed on Feb. 6, 2008.

(51) Int. Cl.
*B01F 7/20* (2006.01)

(52) U.S. Cl. ..... 366/65; 366/129; 366/142; 366/325.92; 366/325.93

(58) Field of Classification Search ..... 366/64–66, 366/129, 142, 325.92, 325.93, 328.1, 343; 241/277; 416/70 R, 228
See application file for complete search history.

(56) References Cited

U.S. PATENT DOCUMENTS

| | | | | | |
|---|---|---|---|---|---|
| 59,449 | A | * | 11/1866 | Pratt | 261/33 |
| 78,925 | A | * | 5/1868 | Cassard | 366/149 |
| 84,953 | A | * | 12/1868 | Lord et al. | 416/228 |
| 151,887 | A | * | 6/1874 | Kitchen | 366/325.93 |
| 190,238 | A | * | 5/1877 | Monroe | 416/77 |
| 190,628 | A | * | 5/1877 | Scofield | 415/8 |
| 193,493 | A | * | 7/1877 | Eberhart | 416/76 |
| 302,794 | A | * | 7/1884 | Taylor | 74/89.13 |
| 1,151,372 | A | * | 8/1915 | Moore | 416/77 |
| 1,394,315 | A | * | 10/1921 | Lewis | 192/17 R |
| 1,498,509 | A | * | 6/1924 | Arnold | 416/71 |
| 1,530,716 | A | * | 3/1925 | Doerr | 366/129 |
| 1,854,732 | A | * | 4/1932 | Beran | 366/304 |
| 1,916,192 | A | * | 7/1933 | David | 241/292.1 |
| 2,190,105 | A | * | 2/1940 | Mock | 241/277 |
| 2,240,237 | A | * | 4/1941 | Anderson | 241/169.1 |
| 2,699,925 | A | * | 1/1955 | Madl | 416/122 |
| 3,166,303 | A | * | 1/1965 | Chapman | 366/129 |
| 4,936,688 | A | * | 6/1990 | Cornell | 366/146 |
| D316,100 | S | * | 4/1991 | Kief | D15/19 |
| 5,109,930 | A | | 5/1992 | Napier | |
| 5,348,391 | A | | 9/1994 | Murray | |
| 5,368,386 | A | | 11/1994 | Murray | |
| 5,395,167 | A | | 3/1995 | Murray | |
| 5,470,148 | A | | 11/1995 | Gorr et al. | |
| 5,797,678 | A | | 8/1998 | Murray | |
| 6,000,836 | A | | 12/1999 | Nemazi et al. | |
| 6,033,105 | A | | 3/2000 | Barker et al. | |
| 6,120,174 | A | | 9/2000 | Hoag et al. | |
| 6,412,569 | B1 | | 7/2002 | Webb | |
| 6,994,465 | B2 | | 2/2006 | Tague et al. | |
| 7,029,163 | B2 | | 4/2006 | Barker et al. | |
| 2004/0196735 | A1 | | 10/2004 | Barker et al. | |
| 2005/0018533 | A1 | * | 1/2005 | Whitney | 366/129 |
| 2005/0105385 | A1 | | 5/2005 | McGill et al. | |

* cited by examiner

*Primary Examiner* — David Sorkin
(74) *Attorney, Agent, or Firm* — Day Pitney LLP; Brian R. Pollack, Esq.

(57) ABSTRACT

A mixing tool is provided for mixing, in a mixing container, plural materials including a first material and a second material. The mixing tool has a shaft and a first mixing member. The first mixing member has a visual reference for indicating when a predetermined volume of the first material is deposited in the mixing container.

18 Claims, 15 Drawing Sheets

CONCRETE MIXING SYSTEM

RELATED APPLICATIONS

This application is a continuation in part of U.S. patent application Ser. No. 12/361,198, filed Jan. 28, 2009, now abandoned which claimed priority under 35 U.S.C. §119(e) to U.S. Provisional Patent Application No. 61/026,517, filed on Feb. 6, 2008, each of which is incorporated herein by reference.

BACKGROUND OF THE INVENTION

1. Field of the Invention

The present invention pertains to masonry tools and specifically to a concrete mixing tool.

2. Background of the Invention

Tools for mixing concrete have been regularly used by masons for forming a concrete slimy mixture from, for example, a standard sixty pound (60 lb) bag of pre-blended concrete such as Sakrete Concrete Mix, which is readily purchased, en mass, from Home Depot. Such a mixture is required when, for example, preparing a footing for a four by four by eight foot (4'×4'×8') pressure treated fence post.

One example of a mixing tool is disclosed in U.S. Pat. No. 5,470,148 to Gorr for a "Portable Cement-Mixing Apparatus Having Upper and Lower Notched Plates Affixed to a Shaft", issued on Nov. 28, 1995. This reference provides an engine driven shaft having plural paddles disposed thereon. This reference discloses that the shaft is sized to fit the mixing container in which it is typically used. For example, the shaft is thirteen inches (13") if it used with a wheelbarrow, twenty five inches (25") if it is used with a mortar box and thirty six inches (36") if it used for a sono tube. Opposing wings or vanes on the tool form an open volume therebetween which causes the mixture to flow properly.

Another example of a mixing tool is disclosed in U.S. Pat. No. 6,412,569 to Webb for a "Concrete Mixing Hoe", issued on Jul. 2, 2002. The reference discloses a hoe used with a nascent slurry of dry concrete pre-mix components including finely divided Portland cement particles, sand and gravel aggregate, and water for intermixing the ingredients. Plural holes are provided on a blade so that water and less viscous slurry can pass through a lower hole while gravel aggregate, sand and more viscous slurry can pass through an upper hole.

None of the above structures provide visual reference means disposed on the mixing tool for providing a visual indicator of when water level in a mixing container is high enough to mix with a preselected volume of pre-blended concrete.

SUMMARY OF THE INVENTION

In view of the deficiencies in the prior art, it is an object of the invention to provide a visual reference means disposed on a mason's mixing tool for serving as a visual indicator of when water level in a mixing container, such as a pail, is high enough to properly mix a bag of pre-blended concrete.

In accordance with the objects of the invention, a mixing tool is provided for mixing, in a mixing container, plural materials including a first material and a second material. The mixing tool has a shaft and a first mixing member. The first mixing member has a visual reference for indicating when a predetermined volume of the first material is deposited in the mixing container.

BRIEF DESCRIPTION OF THE DRAWINGS

In order that the manner in which the above recited objectives are realized, a particular description of the invention will be rendered by reference to specific embodiments thereof that are illustrated in the appended drawings. Understanding that the drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Figure 1:
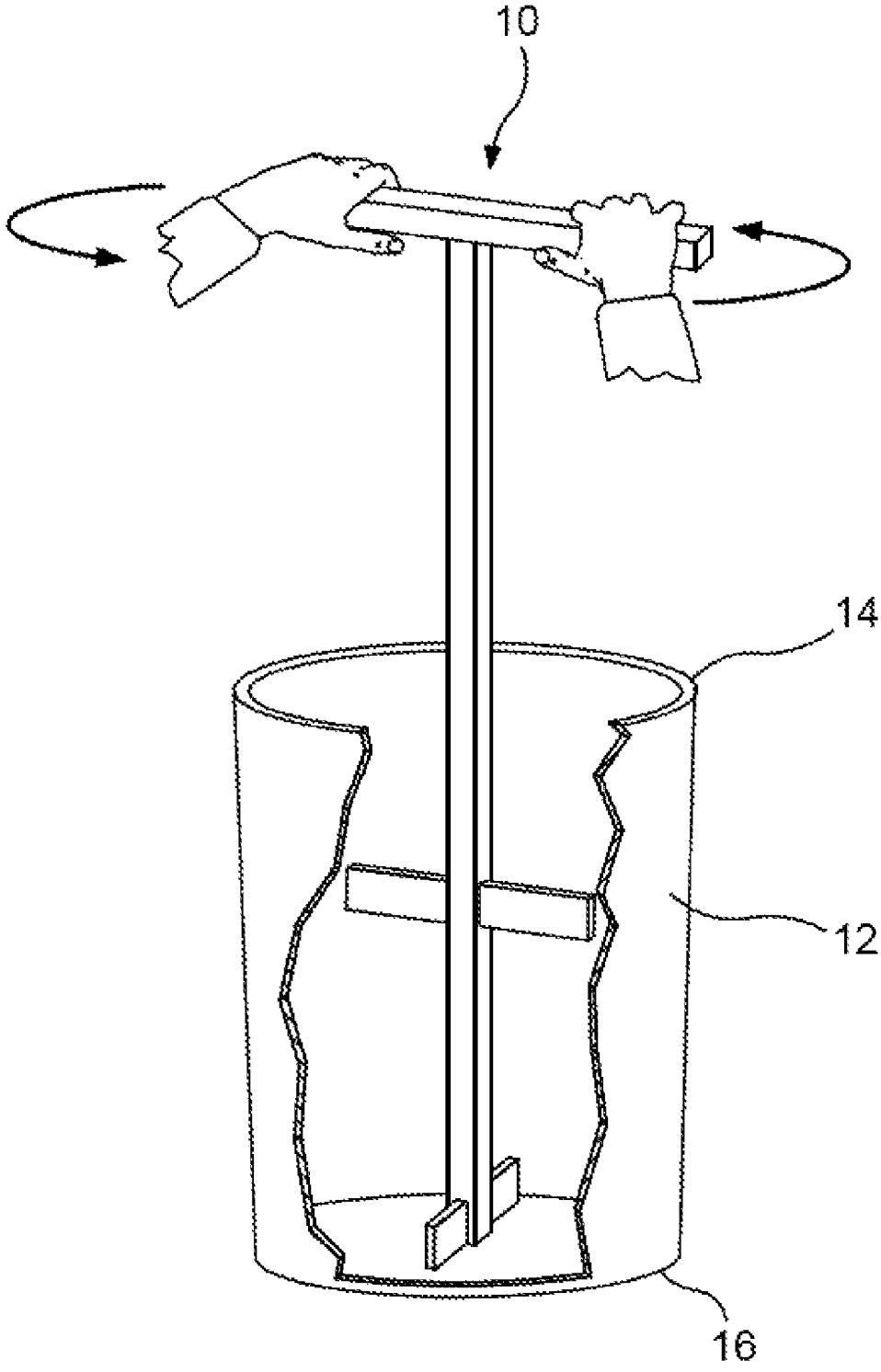
FIG. 1 illustrates an embodiment of the mixing tool and mixing container of the present invention.

FIG. 1 discloses one embodiment the inventive mixing tool 10 in a mixing container 12. The mixing container 12 can be any suitable container, such as a wheelbarrow, a mortar box or a sono tube. For exemplarily purposes, the mixing container 12 is illustrated as, and will be referred to hereinafter as, a mixing pail 12. An example mixing pail 12 is a five gallon mixing pail, such as that which can be obtained from United States Plastic Corp., 1390 Neubrecht Rd. Lima, Ohio 45801-3196. The mixing pail has a tapered design with an approximate twelve inch (12") diameter at the pail top 14, an eleven inch (11") diameter at the pail bottom 16, and a height of approximately fifteen inches (15"). The mixing pail 12 is fabricated from high-density polyethylene having a wall thickness of approximately one tenth of an inch.

Figure 2:
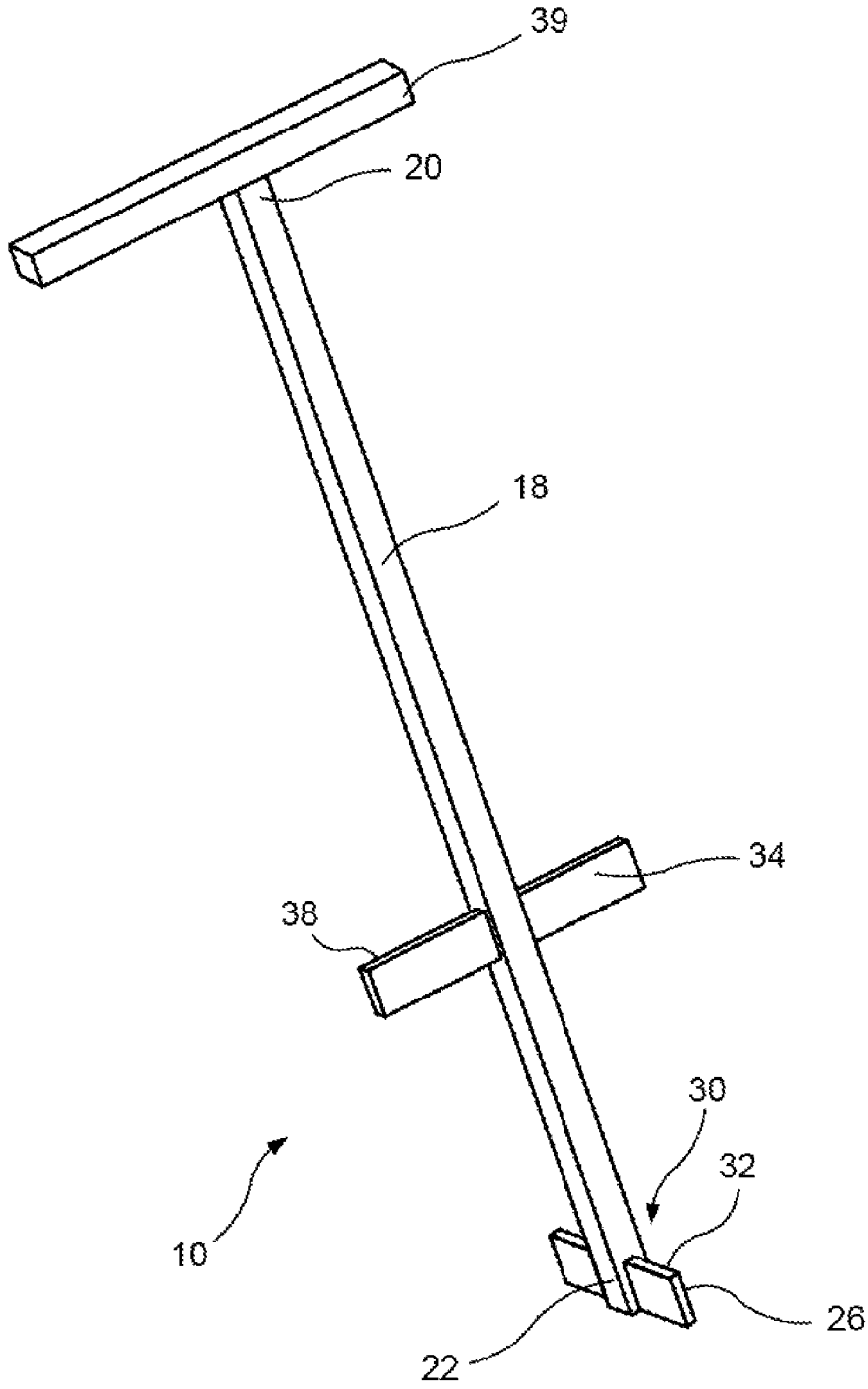
FIG. 2 further illustrates the mixing tool in FIG. 1.

As illustrated in FIG. 2, the mixing tool 10 includes an elongated shaft 18. The shaft 18 is made of a material which is durable and rigid enough to handle repetitive strain of mixing pre-blended concrete over an extended useful life. For example, the material is an iron square stock, having an outer dimension of one and a half inches (1½") and an eighth inch (⅛") wall thickness. The shaft 18 has opposing top and bottom ends 20, 22, and a length that enables a standing mason to comfortably mix pre-blended concrete. For example, the shaft 18 has a length of approximately forty inches (40").

On the bottom end 22 of the shaft 18 is a first mixing member 26. The first mixing member 26 is manufactured from a material which is strong enough to handle repetitive mixing of pre-blended concrete over an extended useful life. The first mixing member can be a plate, a square stock, a rod, or any other known and suitable material. For exemplarily purposes, the first mixing member 26 is illustrated as, and will be referred to hereinafter as, a first mixing plate 26. The first mixing plate 26 is same material thickness and material type as the shaft 18, e.g., one-quarter inch (¼") thick iron.

The first mixing plate 26 has a length which runs perpendicular to the axial length of the tool shaft 18 and a height which runs parallel to the axial length of the tool shaft 18. The length of the first mixing plate 26 is such that pre-blended concrete is easily and freely mixed within the mixing pail 12. For example, where the mixing pail 12 has a ten inch (10") bottom diameter, the first mixing plate 26 has a length of nine inches (9").

The first mixing plate 26 is connected to the shaft 18 via a notch (not shown), large enough to seat the first mixing plate 26, disposed in the bottom 22 of the shaft 18. Once seated, the first mixing plate 26 is welded against the shaft 18 or removably bolted to the shaft 18.

The top portion of the first mixing plate 26 includes visual reference means 30 for indicating when water level in the mixing pail 12 is high enough to properly mix the volume of pre-blended concrete. The visual reference means functions by positioning the bottom 22 of the shaft 18 against the bottom 16 of the substantially empty mixing pail 12 and partially filling the mixing pail 12 with water. As water rises toward the top of the first mixing plate 26, the mason stops filling the mixing pail 12 upon receiving a proper visual indicator (discussed below) from the visual reference means 30. Thereafter, the mason loads into the mixing pail 12 the pre-blended volume of concrete. Using the ratio of the pre-blended concrete mix and water within the mixing pail 12, an optimal concrete slurry can be mixed using the mixing tool 10 without having to further adjust the contents therein.

The first mixing plate 26 illustrated in FIGS. 1 and 2 has a rectangular surface area. Accordingly, the entire top edge 32 of the first mixing plate 26 defines the visual reference means 30. The visual indicator provided by the visual reference means 30 occurs when water filling the mixing pail 12 just covers the top edge 32 of the first mixing plate 26. At that point, the mason can cease filling the pail with water and fill add the pre-blended concrete.

One of ordinary skill would appreciate that the weight of a sixty pound bag of pre-blended concrete, unloaded into the bucket at one time, might hinder some tired or weaker masons from effectively utilizing the mixing tool for mixing the water with the pre-blended concrete. With the confidence that the proper water is in the pail, the mason can unload portions of the bag of pre-blended concrete into the pail, mix the pail contents into a slurry, and thereafter unload further portions of the bag of pre-blended concrete until the contents of the bag of pre-blended concrete are entirely within the pail.

As an example, testing has shown that approximately three inches of water in the aforementioned United States Plastic Corp mixing pail is enough to create an optimal concrete mix from a sixty pound (60 lb) bag of pre-blended concrete. Accordingly, if the mason intends on mixing concrete using a sixty pound (60 lb) bag of pre-blended concrete, the first mixing plate 26 would be three inches high. When water comes up to the height of the top edge of the first mixing plate 26, there would be just enough water in the pail to properly mix the sixty pound (60 lb) bag of pre-blended concrete.

As can be appreciated, the mason may want to use the tool with different types of mixing containers and/or to mix different volumes of pre-mixed concrete. If the mason were to use forty pound (40 lb) or fifty pound (50 lb) bag of pre-blended concrete, the height of the rectangular mixing plate would need to be different than that for a sixty pound (60 lb) bag to properly position the visual reference means 30. Removeably connecting the first removable plate 26 to the tool 10 enables a mason to swap-out the first removable plate 26 for a plate of a different height. That is, providing a plate with a different height would move the location of the visual reference means 30 to an appropriate location A second mixing member 34 is provided between top and bottom ends 20 and 22 of the shaft 18. The second member 34 serves as an aid for agitating and mixing the pre-blended concrete into the required slurry. For exemplarily purposes, the material and outer dimensions of the second mixing member 34 are the same as those for the first mixing plate 26, and the second mixing member will be referred to hereinafter as the second mixing plate 34.

Figure 3:
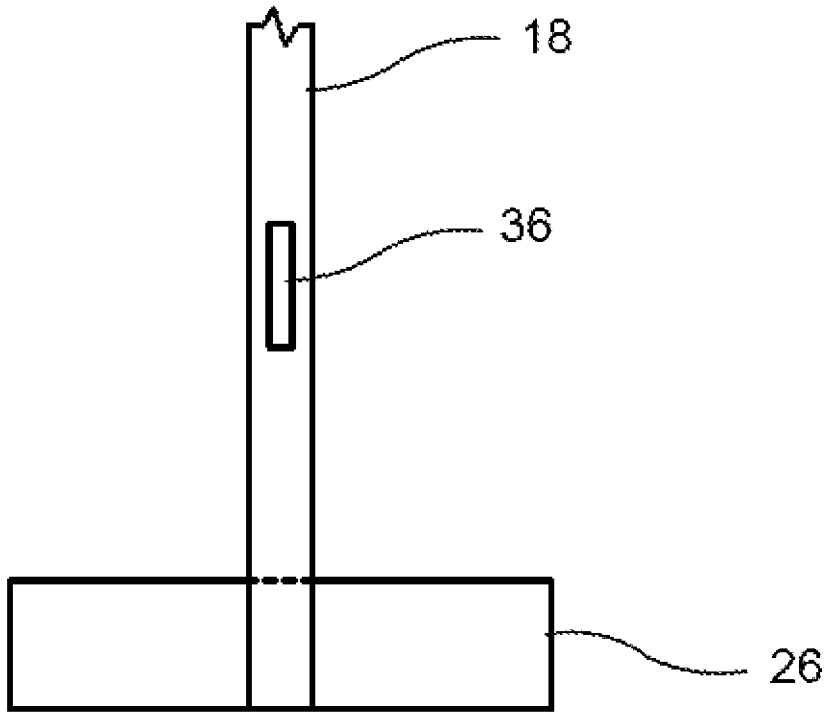
FIG. 3 illustrates a mounting slot for a mounting a mixing member in the mixing tool of FIG. 1.

The second mixing plate 34 can be connected to the shaft 18 in the same way as the first mixing plate 26. For example, a slot 36 (FIG. 3) can be provided in the side wall of the shaft 18 which matches the cross section of the second mixing plate 34. The second mixing plate 34 is then welded or bolted to the shaft 18 as previously disclosed.

The second plate 34 is located such that a top edge 38 thereof would be within the slurry of concrete mix and not above the slurry when the bottom 22 of the shaft 18 is against the bottom 16 of the mixing pail 12. For example, testing has shown that when mixing a sixty pound bag of pre-blended concrete in a United States Plastic Corp. mixing pail, the top edge 38 of the second mixing plate 34 is properly located a eight and a half inches (8½") from the bottom 22 of the shaft 18.

In the embodiment illustrated in FIG. 2, the first mixing plate 26 is turned ninety degrees along the long axis of the shaft 18 relative to the second mixing plate 34. This provides for optimal agitation as compared to other relative orientations between the first and second mixing plates 24 and 34.

On the top end 20 of the shaft 18 is a handle 39. The handle 39 is long enough to enable a mason to easily mix pre-blended concrete. For example, the handle 39 has a total length of sixteen inches (16"). The handle 39 is preferably made of the same type of material as the shaft 18. For example, the handle 39 may be one inch (1") square iron stock having a wall thickness of an eighth of an inch (⅛"). The handle 39 is connected to the shaft 18 in the same way that the first mixing plate 26 is connected. That is, the handle 39 is connected via a notch (not shown), large enough to seat the handle 39, where the notch is disposed in the top 20 of the shaft 18. At the top 20 of the shaft 18, the handle 39 is welded against the shaft 18 or removably bolted to the shaft 18.

The handle 39 and second mixing plate 34 extend parallel to each other relative to the long axis of the shaft 18. This provides for ease of transportation because the largest portion of the assembled mixing tool 10 is positioned in a single plane. Further ease of transportation is achieved by unbolting and removing the first mixing plate 26 from the mixing tool 10 so that the entire mixing tool 10 is configured a single plane. With the first mixing plate 26 removed, the entire mixing tool 10 can rest on a flat surface (e.g., the floor of a mason's truck) and not project from the surface more than the thickness of the shaft 18.

Of course, if the tool 10 is designed to be driven by a drill, the top end 20 of the shaft would not have a handle 39 but would instead be formed to fit in a drill chuck.

It is to be noted that the mixing tool 10 can be readily manufactured from iron as disclosed, but also from aluminum, plastic, wood, composites, etc. The materials can be square stock, round stock, or any other available and appropriate stock, and the mixing tool 10 can be solid or hallow. Determining the precise materials and dimensions thereof will be within the skill level of one of ordinary skill in the art after reading the present disclosure.

While the mixing tool 10 and mixing pail 12 can be sold in a kit, the mixing tool 10 can be sold separately when used with a standard pail, such as the United States Plastic Corp mixing pail. Such pail or equivalent thereof is readily available.

As can be seen by viewing the above disclosure of the mixing tool 10, a mason using the tool 10 when filling the mixing pail 12 with water need not worry about periodically measuring the amount of water filling the mixing pail 12 or guessing whether the proper amount of water has filled the mixing pail 12. Inexact proportions of water to pre-blended concrete will cease to be an issue.

Various alternative embodiments will now be disclosed without departing from the spirit of the invention.

Figure 4:
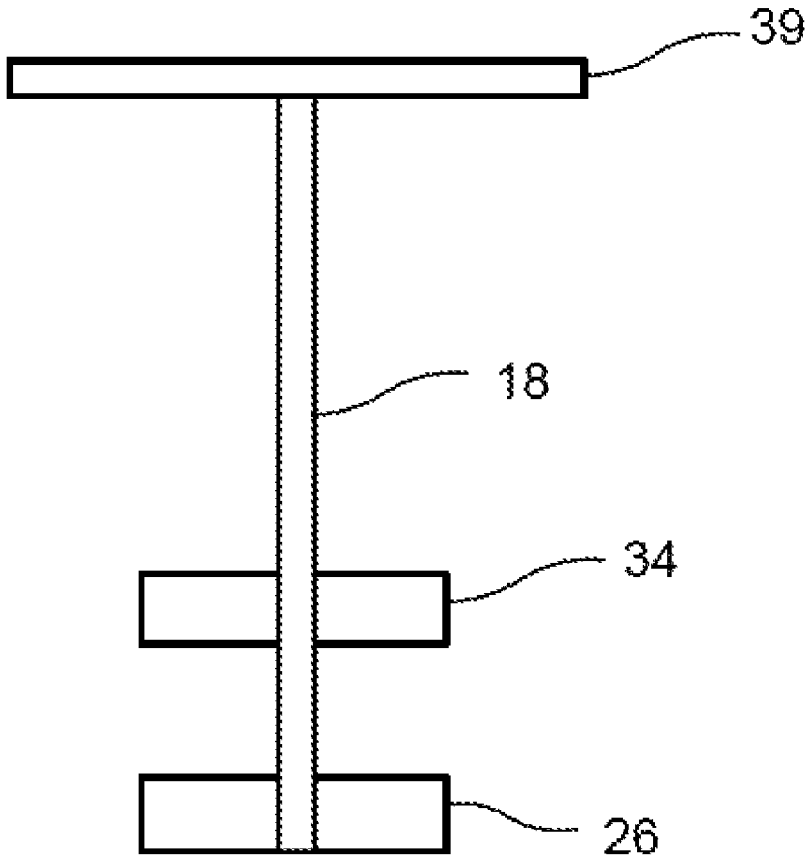
FIG. 4 illustrates one alternative embodiment of the mixing tool of the present invention.

In one alternative embodiment of the invention, illustrated in FIG. 4, each of the first and second mixing members 26 and 34 are on the same plane as the handle 39. While detracting slightly from the ease of mixing, this configuration allows for simple storage as the entire mixing tool 10 can be placed on its side in a mason's truck without having to remove the first mixing plate 26.

Figure 5:
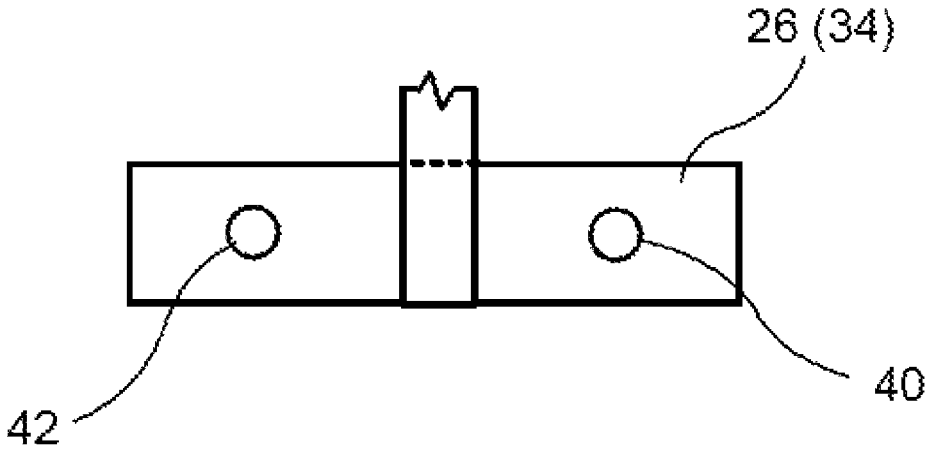
FIG. 5 illustrates a second alternative embodiment of the mixing tool of the present invention.

In a second alternative embodiment of the invention, illustrated in FIG. 5, the first and second mixing members 26 and/or 34 have one or more agitation facilitating holes 40, 42 disposed therein.

Figure 6:
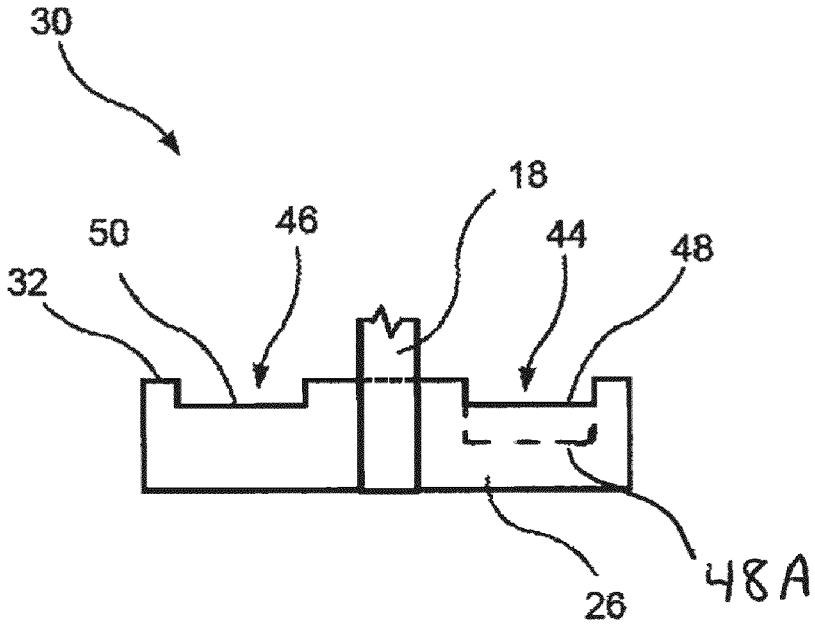
FIG. 6 illustrates a third alternative embodiment of the mixing tool of the present invention.

In a third alternative embodiment of the invention, illustrated in FIG. 6, the visual reference means 30 in the first mixing plate 26 is defined by a contour in the top edge 32. As illustrated in FIG. 6, the contour is defined by plural mixing notches 44, 46 disposed in the top edge 32 of the first mixing plate 26. The bottom surface of the contour is defined by edges 48, 50 of the notches, which provide the visual indicator of when a proper water fill height is established in the mixing pail 12.

Figure 7:
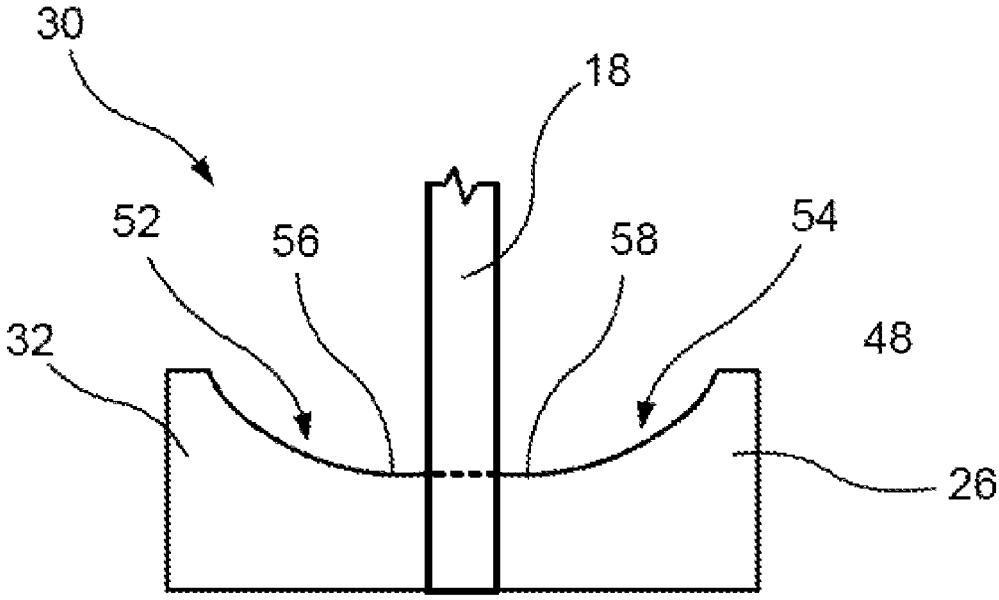
FIG. 7 illustrates a fourth alternative embodiment of the mixing tool of the present invention.

The notches illustrated in FIG. 6 have a rectangular cross section 46, 48, but in a fourth alternative embodiment of the invention, illustrated in FIG. 7, the notches can have a parabolic cross-section 52, 54. In such an embodiment, the bottom edges 56, 58 of the parabolic notches 52, 54 provide the visual indicator of when a proper water fill height is established in the mixing pail 12.

Furthermore, the top edge 32 of the first mixing plate 26 can be provided with plural contours. For example, the bottom edge of one notch 48 or 50, 56 or 58 in either pair of disclosed notches can be located at a same or different height level as compared with the other notch in the mixing plate 26 (see notch 48A, illustrated in phantom lines in FIG. 6). Different height levels provide a visual indication of sufficient water levels for different volumes of pre-mixed concrete. For example, one bottom edge can provide a visual indicator of when enough water is in the mixing pail 12 to mix a forty pound (40 lb) bag of pre-mixed concrete while the other bottom edge can provide a visual indicator of when enough water is in the mixing pail 12 to mix a sixty pound (60 lb) bag of pre-mixed concrete.

Figure 8:
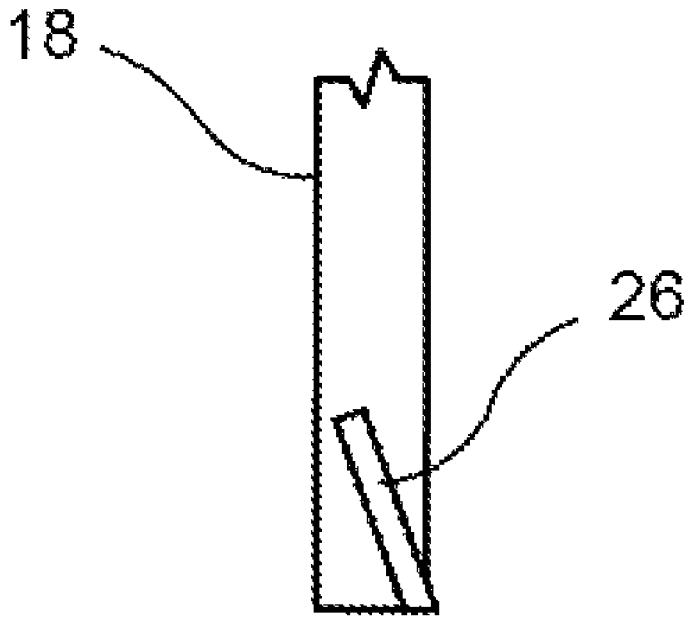
FIG. 8 illustrates a fifth alternative embodiment of the mixing tool of the present invention.

In a fifth alternative embodiment of the invention, illustrated in FIG. 8; the first mixing plate 26 is disposed at an angle on the shaft 18. This embodiment enables a mason using the mixing tool 10 to scrape product from the bottom 16 of the mixing pail 12 while twisting the shaft 18 with the handle 39.

Figure 9:
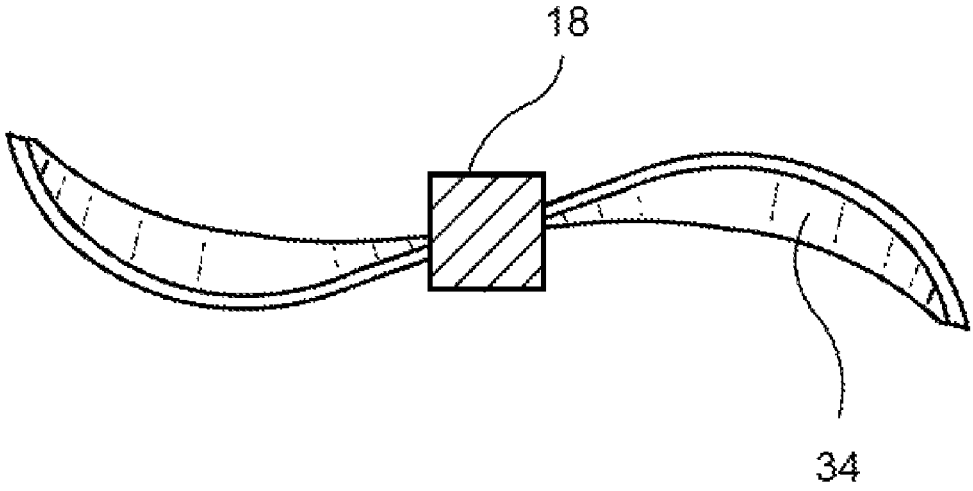
FIG. 9 illustrates a sixth alternative embodiment of the mixing tool of the present invention.

In sixth alternative embodiment of the invention, illustrated in FIG. 9, the first mixing plate 26 can have a curved shape from a top elevational viewpoint. Such a shape is advantageous as it provides for greater torsion bending resistance if the mixing plate 26 is manufactured from plastic or a relatively thinner metal.

Figure 10:
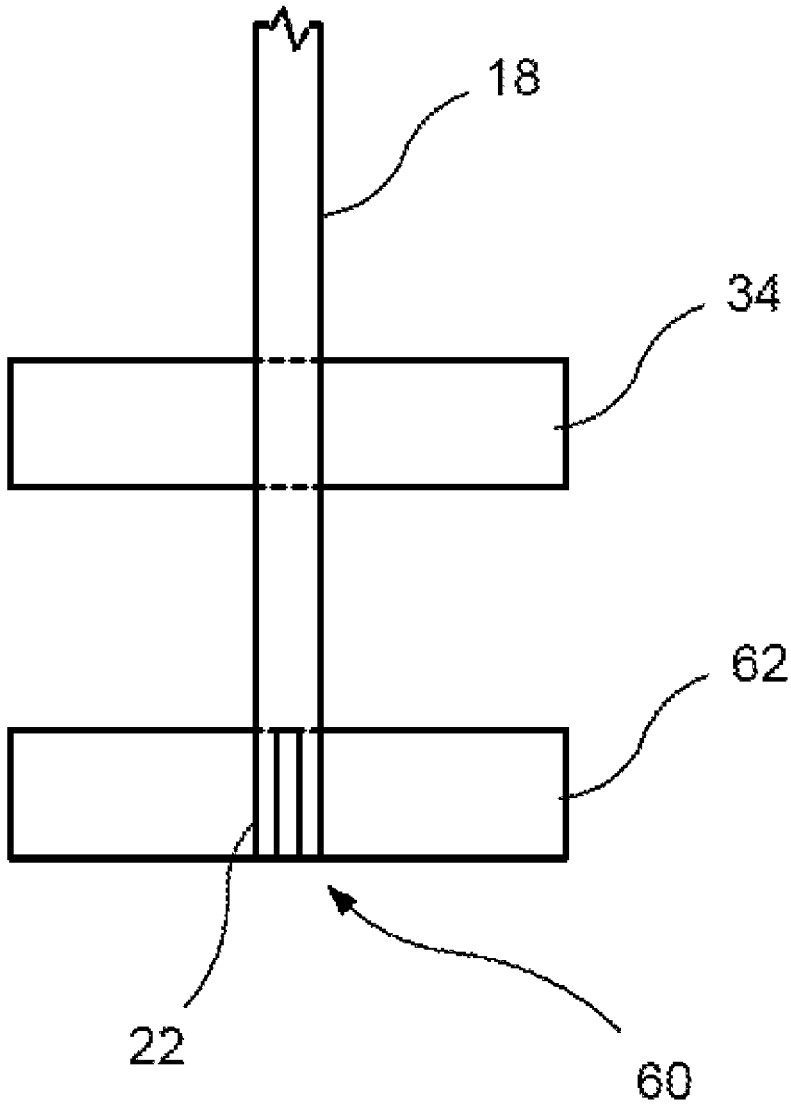
FIG. 10 illustrates a seventh alternative embodiment of the mixing tool of the present invention.
Figure 11:
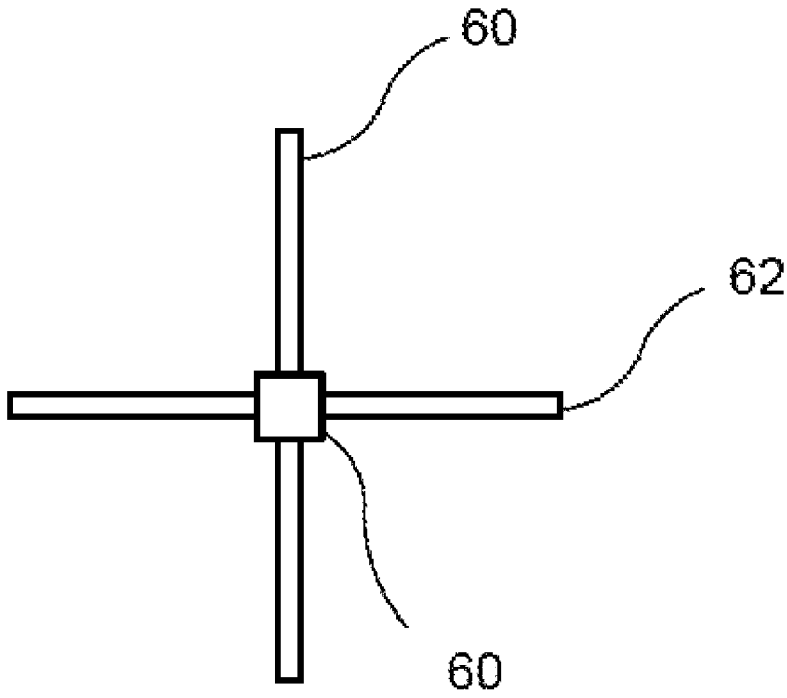
FIG. 11 illustrates an elevational view of the seventh alternative embodiment of the mixing tool of the present invention.
Figure 12:
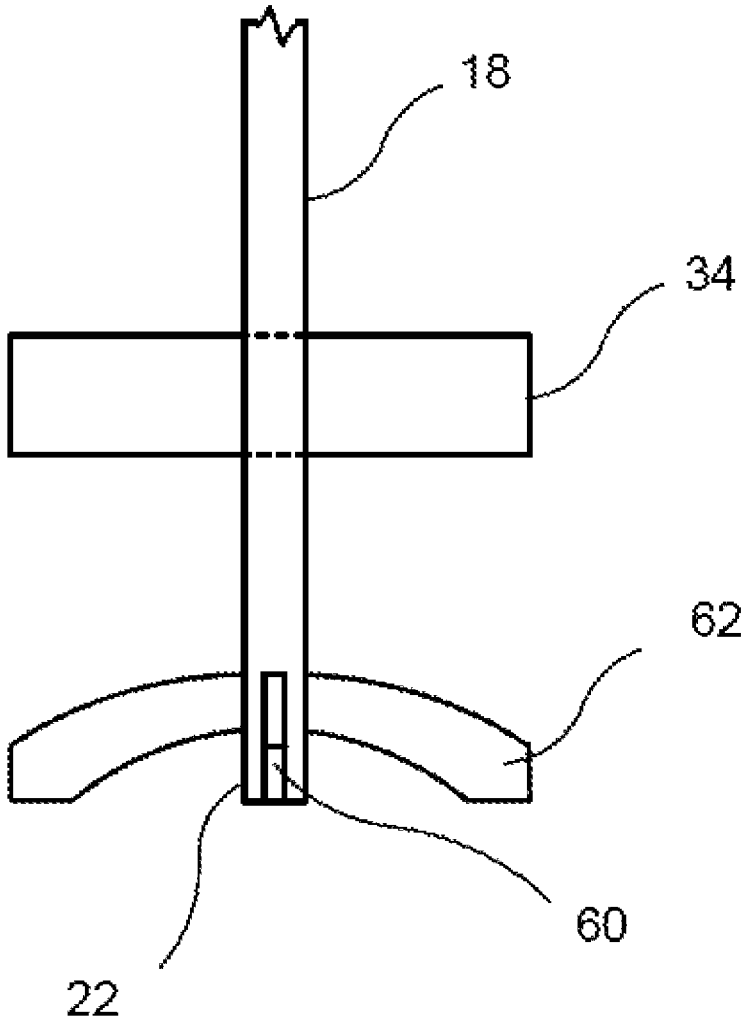
FIG. 12 illustrates an eighth alternative embodiment of the mixing tool of the present invention.

In a seventh alternative embodiment of the invention, illustrated in FIGS. 10 and 11, the first mixing plate 26 can be replaced with two or more mixing members 60, 62 disposed at the same axial location of the shaft, i.e., at the bottom 22 of the shaft 18. Such would provide for enhanced agitation and enable the mixing tool 10 to stand upright when not being used. Each of the mixing members 60, 62 can incorporate any of the visual reference means 30 disclosed and each can be removably or fixedly attached to the shaft 18. Alternatively, in an eighth alternative embodiment of the invention, illustrated in FIG. 12, one of the mixing members 62 can have an inverse parabolic cross section on both the top and bottom edges of the mixing member 62. While the outermost location on the top edge can serve as the visual reference means 30, the contour of the bottom edge enhances the ability of agitating a mixture thereunder.

Figure 13:
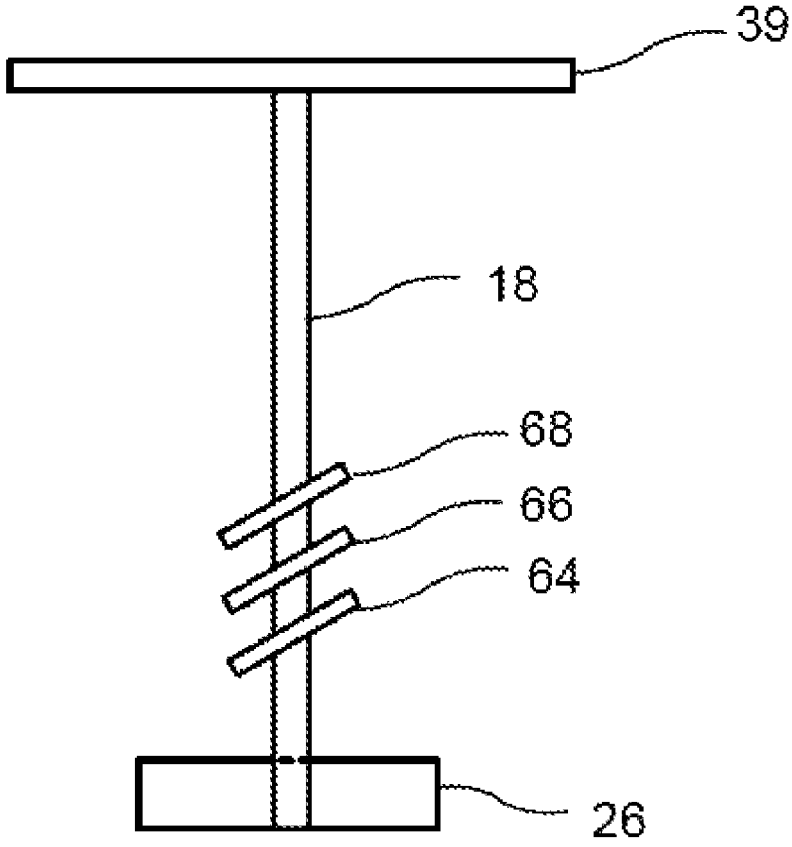
FIG. 13 illustrates a ninth alternative embodiment of the mixing tool of the present invention.

In a ninth alternative embodiment of the invention, illustrated in FIG. 13, the second mixing plate 34 can be replaced with plural mixing members 64, 66, and 68 which are circumferentially aligned with and axially spaced from each other and disposed at an angle to the first mixing plate 26. The effect of orienting the mixing members 64, 66 and 68 as such is to provide an elongated spiral mixing member. The effective spiral mixing member assists in further agitating the concrete slurry by lifting the slurry or compressing the slurry, depending on the turning direction of the mixing tool 10, as can be appreciated by one of ordinary skill in the art.

Figure 14:
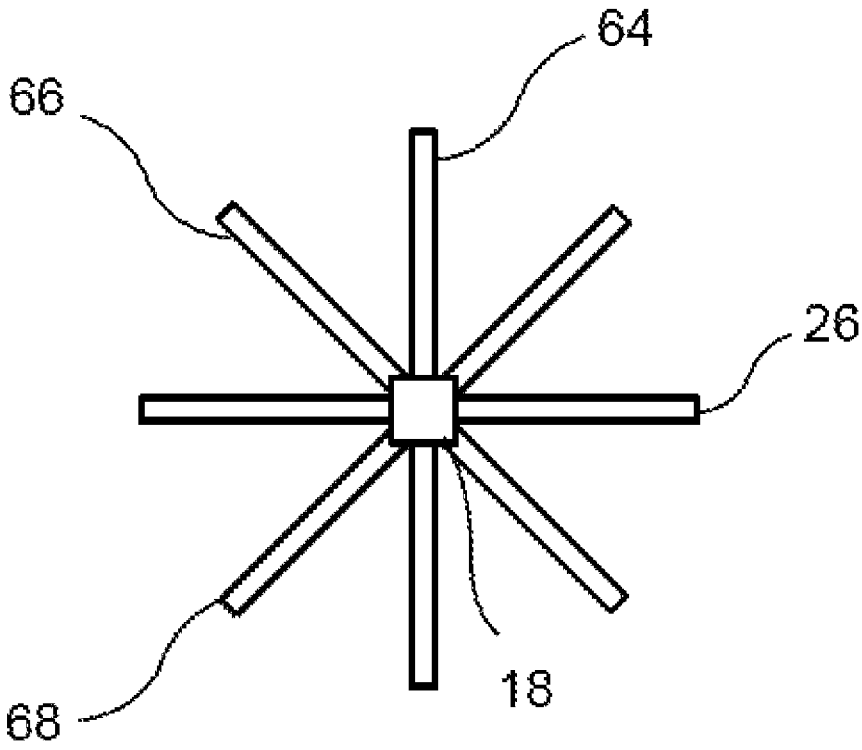
FIG. 14 illustrates a tenth alternative embodiment of the mixing tool of the present invention.

As illustrated in FIG. 14, the plural mixing members need not be disposed at an angle to the first mixing plate 26. Rather, they can be staggered across the length of the shaft 18 and circumferentially offset from each other by predetermined increments, such as the illustrated sixty degree increments. So long as the top edge of the top mixing member 68 is disposed in the slurry while mixing concrete, the additional mixing members will tend to allow for a more rapid mixing of the concrete.

Figure 15:
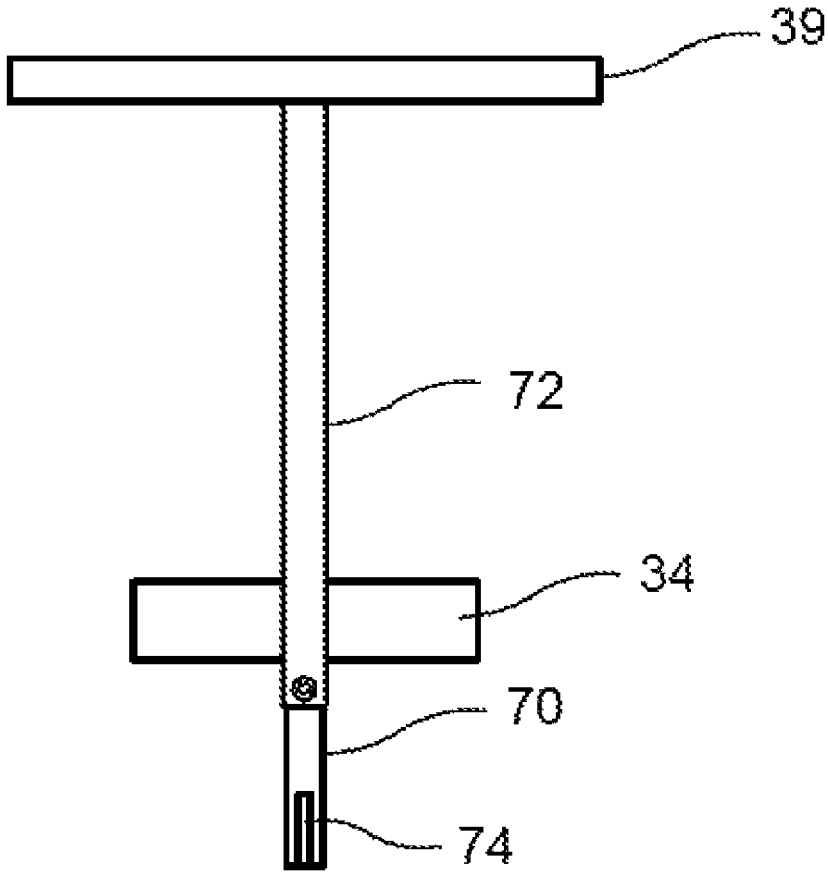
FIG. 15 illustrates an eleventh alternative embodiment of the mixing tool of the present invention.

In a tenth alternative embodiment of the invention, illustrated in FIG. 15, the shaft is disposed in two telescoping portions 70, 72. This provides for ease of use for different height users. With the first mixing plate 26 removed from the provided notch 74, i.e., removably attached by a bolt, the mixing tool as a whole can be easy transported, stored in a user's storage facility and/or easily distribution in commerce.

It is to be appreciated that the inventive mixing system could modified for mixing mortar, spackle, grout or the like. Such modification would be within the capabilities of one of ordinary skill having read the disclosure of the invention and such modifications would be within the scope and breath of the claimed invention.

The present invention may be embodied in other specific forms without departing from its spirit or essential characteristics. The described embodiments are to be considered in all respects only as illustrative and not as restrictive. The scope of the invention is, therefore, indicated by the appended claims and their combination in whole or in part rather than by the foregoing description. All changes that come within the meaning and range of equivalency of the claims are to be embraced within their scope.

I claim:

1. A mixing tool for mixing, in a mixing container with a predetermined internal shape, plural materials including a first material, which is a liquid, and a second material, which is a dry mix;

said mixing tool comprising:

a shaft with a first mixing member fixedly positioned at an axial bottom end of the shaft;

wherein said first mixing member is an elongated, substantially rectangular plate having a plate length which is greater than a plate height and which length extends along a direction that is substantially perpendicular to the shaft axis, and the shaft axis lies along the profile of the plate;

said first mixing member comprising an upwardly facing plate length top edge;

the plate top edge includes, between opposing lengthwise ends:

a first notch, a first bottom of which defining a first visual reference located at a first predetermined distance from a bottom of the shaft; and a second notch, a second bottom of which defining a second visual reference located at a second predetermined distance from a bottom of the shaft which differs by its distance from the bottom of the shaft as compared with the first bottom of the first notch;

wherein, when the bottom of the shaft is against an interior bottom of the container:

a first slurry concentration is consistently obtained by filling the container with a first predetermined amount of the dry mix and a first predetermined amount of the liquid to the first notch and mixing;

a second slurry concentration is consistently obtained by filling the container with a second predetermined amount of the dry mix and a second predetermined amount of the liquid to the second notch and mixing; and the first and second slurry concentrations are consistently substantially the same.

2. The mixing tool of claim 1, wherein at least one of said notches is a contoured edge and a lower surface of said contoured edge defines said visual reference.

3. The mixing tool of claim 1, wherein said first mixing member comprises at least one aperture and/or a lower edge contour for enhancing mixing of materials when deposited in said mixing container.

4. The mixing tool of claim 1, comprising a second mixing member disposed at an axially same location along said shaft as said first mixing member and circumferentially offset from said first mixing member.

5. The mixing tool of claim 1, wherein a height-wise axis of said first mixing member is disposed at an angle to said shaft.

6. The mixing tool of claim 1, wherein a second mixing member is circumferentially offset from or circumferentially aligned with said first mixing member.

7. The mixing tool of claim 6 further comprising a handle disposed on said shaft at an axial top end of said shaft, which is an axial opposite end from said first mixing member, said handle being circumferentially aligned with said second mixing member.

8. The mixing tool of claim 7, where the handle is extends perpendicularly away from the shaft.

9. The mixing tool of claim 8, where the handle is rigidly connected to the shaft.

10. The mixing tool of claim 9, where the handle is connected at a midsection thereof to a notch it the shaft.

11. The mixing tool of claim 1 comprising a plurality of secondary mixing members axially offset on said shaft from said first mixing member.

12. The mixing tool of claim 11 wherein said plurality of secondary mixing members are plates which are:

circumferentially offset from each other on said shaft; or circumferentially and axially aligned with each other and axially angled to said first mixing member.

13. The mixing tool of claim 1 wherein said shaft comprises plural telescoping and removably connected shaft members.

14. A kit comprising the mixing tool of claim 1 and a mixing container.

15. The kit of claim 14 wherein said mixing tool is a concrete mixer and said mixing container is an open ended pail.

16. The kit of claim 14 comprising a plurality of interchangeable mixing members, each with different visual references for indicating when different predetermined volumes of said dry mix and liquid are deposited in said mixing container.

17. The mixing tool of claim 1, wherein said first mixing member is removably or fixedly attached to said shaft.

18. The mixing tool of claim 1, comprising a second mixing member disposed at an axially offset location along said shaft from said first mixing member.

* * * * *